US012049815B2

(12) United States Patent
Gainer et al.

(10) Patent No.: US 12,049,815 B2
(45) Date of Patent: Jul. 30, 2024

(54) ANALYSIS OF WELL OPERATIONS USING DIMENSIONAL MEASUREMENT DATA

(71) Applicant: Chevron U.S.A. Inc., San Ramon, CA (US)

(72) Inventors: Robert Schuyler Gainer, Houston, TX (US); Caleb Kimbrell Carroll, Spring, TX (US); Douglas Ryan Nally, Houston, TX (US); Jay Patrick Painter, League City, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 267 days.

(21) Appl. No.: 17/449,166

(22) Filed: Sep. 28, 2021

(65) Prior Publication Data

US 2022/0099438 A1 Mar. 31, 2022

Related U.S. Application Data

(60) Provisional application No. 63/198,124, filed on Sep. 30, 2020.

(51) Int. Cl.
*E21B 47/08* (2012.01)
*E21B 19/00* (2006.01)

(52) U.S. Cl.
CPC ..... *E21B 47/08* (2013.01); *E21B 19/00* (2013.01)

(58) Field of Classification Search
CPC ..... E21B 19/00; E21B 47/08
See application file for complete search history.

(56) References Cited

U.S. PATENT DOCUMENTS

| | | | | |
|---|---|---|---|---|
| 5,299,359 | A * | 4/1994 | Estes | G01B 7/13 702/7 |
| 9,605,938 | B2 * | 3/2017 | Helmore | G01B 3/24 |
| 10,626,683 | B2 * | 4/2020 | Hebebrand | E21B 19/02 |
| 10,760,403 | B2 * | 9/2020 | Ellis | G01B 11/105 |
| 11,131,540 | B2 * | 9/2021 | Orban | G01B 11/02 |
| 2002/0121369 | A1 * | 9/2002 | Allen | E21B 47/04 166/242.1 |
| 2015/0285055 | A1 * | 10/2015 | Anderson | E21B 19/166 175/40 |
| 2018/0038220 | A1 * | 2/2018 | Mourre | E21B 47/09 |
| 2018/0096277 | A1 * | 4/2018 | Maidla | G06Q 10/06393 |
| 2020/0182039 | A1 * | 6/2020 | Jorud | E21B 41/0021 |

* cited by examiner

*Primary Examiner* — Nicole Coy
(74) *Attorney, Agent, or Firm* — Esplin & Associates, PC

(57) ABSTRACT

Dimensions of a tool moving in/out of a well may be measured during well operations. The measured dimensions of the tool may be used to analyze the well operations. Analysis of well operations may include identification of types of well operations being performed at the well, monitoring of the well operations, benchmarking of the well operations, identification of tools being used in the well operations, and/or other analysis of the well operations.

16 Claims, 8 Drawing Sheets

ANALYSIS OF WELL OPERATIONS USING DIMENSIONAL MEASUREMENT DATA

CROSS-REFERENCE TO RELATED APPLICATION

The present application claims the benefit of U.S. Provisional Application No. 63/198,124, entitled "ANALYSIS OF WELL OPERATIONS USING DIMENSIONAL MEASUREMENT DATA," which was filed on Sep. 30, 2020, the entirety of which is hereby incorporated herein by reference.

FIELD

The present disclosure relates generally to the field of analyzing well operations using measured dimension of a tool for a well.

BACKGROUND

Manual observations of well operations may be time-consuming, introduce subjectivity into the observations, delay analysis of the well operations, and lead to challenges with quality control. Manual observations of well operations may not allow for remote and accurate analysis of well operations.

SUMMARY

This disclosure relates to analyzing well operations. Dimensional measurement information for a well and/or other information may be obtained. The dimensional measurement information may characterize dimension of a tool for the well. Operation of the well may be analyzed based on the dimensional measurement information and/or other information.

A system that analyzes well operations may include one or more electronic storage, one or more processors and/or other components. The electronic storage may store dimensional measurement information, information relating to a well, information relating to a tool for a well, information relating to dimensional sensor, information relating to operation of a well, information relating to analysis of operation of a well, and/or other information.

The processor(s) may be configured by machine-readable instructions. Executing the machine-readable instructions may cause the processor(s) to facilitate analyzing well operations. The machine-readable instructions may include one or more computer program components. The computer program components may include one or more of a dimension component, an analysis component, and/or other computer program components.

The dimension component may be configured to obtain dimensional measurement information for a well and/or other information. The dimensional measurement information may characterize dimension of a tool for the well.

In some implementations, the dimension of the tool characterized by the dimensional measurement information may include width of a part of the tool as the tool moves into or out of the well. In some implementations, the dimension of the tool characterized by the dimensional measurement information may include shape of a part of the tool as the tool moves into or out of the well.

In some implementations, the dimensional measurement information may be generated by one or more dimensional sensors of the well. The dimensional sensor(s) may be located at and/or below a rig floor of the well, and located above the well.

In some implementations, the dimensional measurement information may be generated for a vertical position above the well. The dimension of the tool characterized by the dimensional measurement information may include the dimension of lateral slices of the tool.

The analysis component may be configured to analyze the operation of the well. The operation of the well may be analyzed based on the dimensional measurement information and/or other information.

In some implementations, analysis of the operation of the well based on the dimensional measurement information may include identification of a type of the operation of the well based on the dimension of the tool.

In some implementations, analysis of the operation of the well based on the dimensional measurement information may include identification of a type of the tool based on the dimension of the tool.

In some implementations, analysis of the operation of the well based on the dimensional measurement information may include determination that the tool is incompatible with the well based on the dimension of the tool.

In some implementations, analysis of the operation of the well based on the dimensional measurement information may include determination of a change in the operation of the well based on a change in the dimension of the tool.

In some implementations, analysis of the operation of the well based on the dimensional measurement information may include determination of speed with which the tool moves into or out of the well based on a change in the dimension of the tool.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a," "an," and "the" include plural referents unless the context clearly dictates otherwise.

DETAILED DESCRIPTION

The present disclosure relates to analyzing well operations. Dimensions of a tool moving in/out of a well may be measured during well operations. The measured dimensions of the tool may be used to analyze the well operations.

Analysis of well operations may include identification of types of well operations being performed at the well, monitoring of the well operations, benchmarking of the well operations, identification of tools being used in the well operations, and/or other analysis of the well operations.

Figure 1:
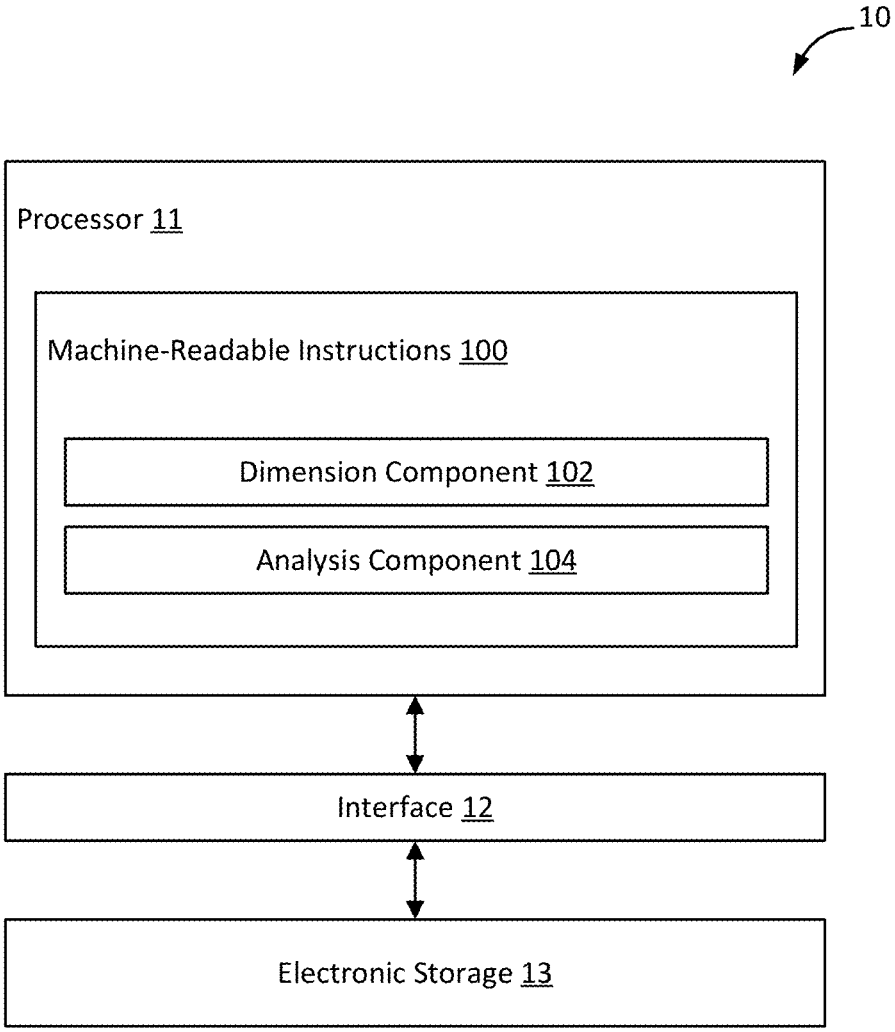
FIG. 1 illustrates an example system that analyzes well operations.

The methods and systems of the present disclosure may be implemented by and/or in a computing system, such as a system 10 shown in FIG. 1. The system 10 may include one or more of a processor 11, an interface 12 (e.g., bus, wireless interface), an electronic storage 13, and/or other components. Dimensional measurement information for a well and/or other information may be obtained by the processor 11. The dimensional measurement information may characterize dimension of a tool for the well. Operation of the well may be analyzed by the processor 11 based on the dimensional measurement information and/or other information.

The electronic storage 13 may be configured to include electronic storage medium that electronically stores information. The electronic storage 13 may store software algorithms, information determined by the processor 11, information received remotely, and/or other information that enables the system 10 to function properly. For example, the electronic storage 13 may store dimensional measurement information, information relating to a well, information relating to a tool for a well, information relating to dimensional sensor, information relating to operation of a well, information relating to analysis of operation of a well, and/or other information.

The processor 11 may be configured to provide information processing capabilities in the system 10. As such, the processor 11 may comprise one or more of a digital processor, an analog processor, a digital circuit designed to process information, a central processing unit, a graphics processing unit, a microcontroller, an analog circuit designed to process information, a state machine, and/or other mechanisms for electronically processing information. The processor 11 may be configured to execute one or more machine-readable instructions 100 to facilitate analyzing well operations. The machine-readable instructions 100 may include one or more computer program components. The machine-readable instructions 100 may include one or more of a dimension component 102, an analysis component 104, and/or other computer program components.

The dimension component 102 may be configured to obtain dimensional measurement information for a well and/or other information. Obtaining dimensional measurement information for a well may include one or more of accessing, acquiring, analyzing, determining, examining, identifying, loading, locating, opening, receiving, retrieving, reviewing, selecting, storing, utilizing, and/or otherwise obtaining the dimensional measurement information. The dimension component 102 may be configured to obtain dimensional measurement information for a well from one or more locations. For example, the dimension component 102 may obtain dimensional measurement information for a well from a storage location, such as the electronic storage 13, electronic storage of a device accessible via a network, and/or other locations. The dimension component 102 may obtain dimensional measurement information for a well from one or more hardware components (e.g., a computing device, a component of a computing device, a sensor, a component of a tool for the well) and/or one or more software components (e.g., software running on a computing device). Dimensional measurement information for a well may be stored within a single file or multiple files.

A well may refer to a hole or a tunnel in the ground. A well may be drilled in one or more directions. For example, a well may include a vertical well, a horizontal well, a deviated well, and/or other type of well. A well may be drilled in the ground for exploration and/or recovery of natural resources in the ground. For example, a well may be drilled in the ground to aid in extraction of petrochemical fluid (e.g., oil, gas, petroleum, fossil fuel). As another example, a well may be drilled in the ground for fluid injection. Application of the present disclosure to other types of wells and wells drilled for other purposes are contemplated.

Numerous operations of the well may need to be observed and recorded to perform analysis of the operations, such as to make sure that the operations are being performed properly. However, manual observation and recordation of well operations may be time-consuming, increase subjectivity, delay analysis of the well operations, and lead to challenges with quality control. Additionally, manual observation and recordation of well operations may not allow for remote and accurate analysis of well operations.

Rather than relying on manual observation and recordation of well operations, dimensional measurements of tool being used at the well (e.g., tool moving into and out of the well) may be used to analyze the well operations. Use of sensors to capture dimensional measurement information may be faster than the manual process, and such data may provide objective data for faster analysis of the well operations, as well as facilitating quality control. Use of dimensional measurement information from sensors may allow for digitization of flat time data and reduction of manual reporting, enhanced remote monitoring of wells, and increase benchmarking capabilities.

Dimensional measurement information may characterize dimension of one or more tools for a well. A tool for a well may refer to material used at the well. A tool for a well may refer to a device or an implement designed and/or used to carry out one or more functions with respect to the well. A tool for a well may refer to a device or an implement that moves in and out of the well. A tool for a well may refer to a part of such device or an implement that is above the well, such as a part of such device between the rig floor area and top of the wellbore. A tool for a well may refer to a device or an implement designed and/or used to perform one or more operations of the well, such as drilling operations, completion operations, production operations, and/or other operations of the well. A tool for a well may refer to the entirety of such a device or one or more parts of such a device. For example, a tool for a well may refer to entirety or one or more parts of drilling string, drill pipe, heavy-weight drill pipe, drill collar, direction tool, bit, wellhead tool, casing tool, completion tool, and/or other tools. Other types of tools for a well are contemplated.

Dimension of a tool for a well may refer to one or more measurable extents of the tool. Dimension of a tool may refer to an external dimension of the tool. For example, dimension of a tool may include length, width, depth, height, diameter, circumference, shape, and/or other dimension of the tool. Other dimension of tools are contemplated.

The dimensional measurement information may characterize dimension of one or more tools for a well by including information that characterizes (e.g., reflects, quantifies, identifies, defines) one or more values, qualities, attributes, features, and/or other aspects of the dimension of the tool(s) for the well. For example, the dimensional measurement information may characterize dimension of a tool for a well by including information that makes up and/or is used to determine dimensional values (e.g., length, width, height, area, volume, angle, shape) of the tool for the well. Other types of dimensional measurement information are contemplated.

Figure 3A:
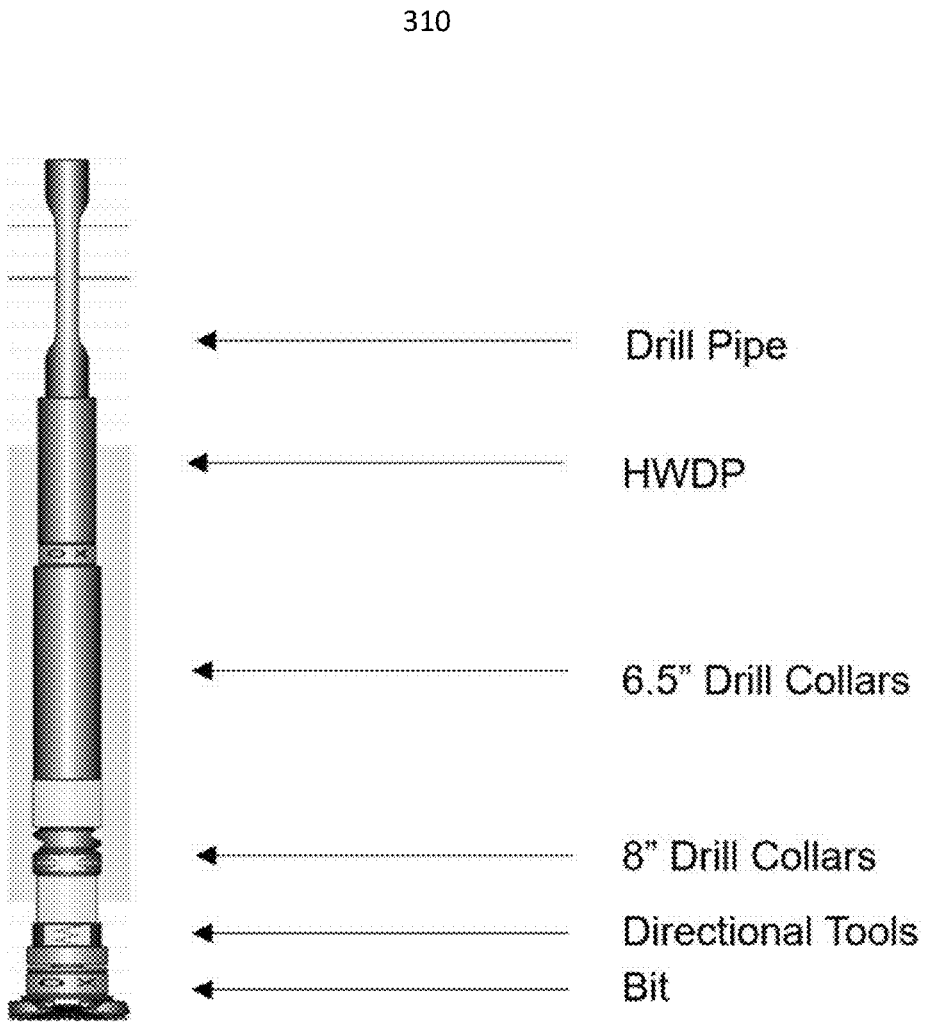
FIGS. 3A, 3B, and 3C illustrate example tools.
Figure 3B:
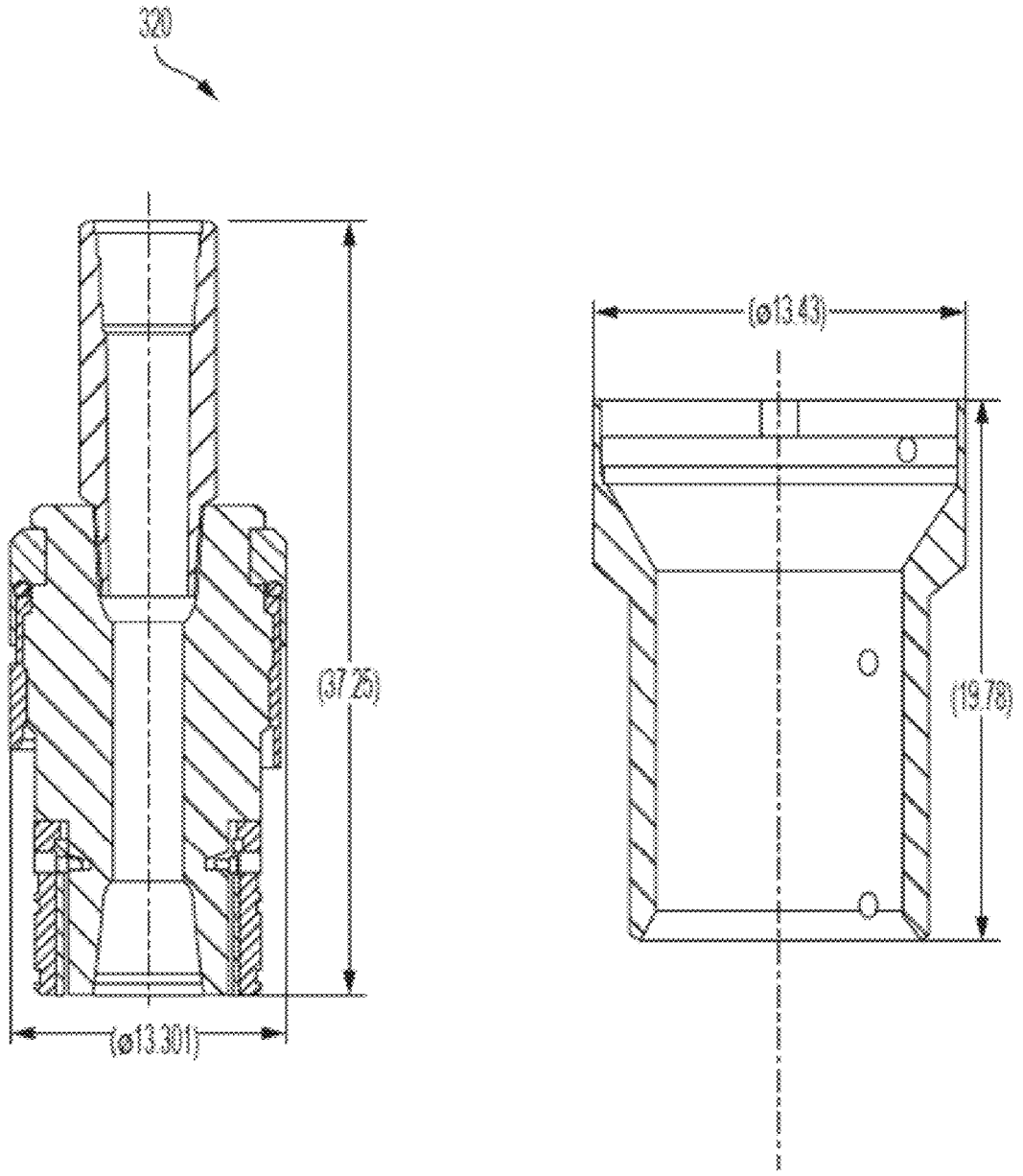
Figure 3C:
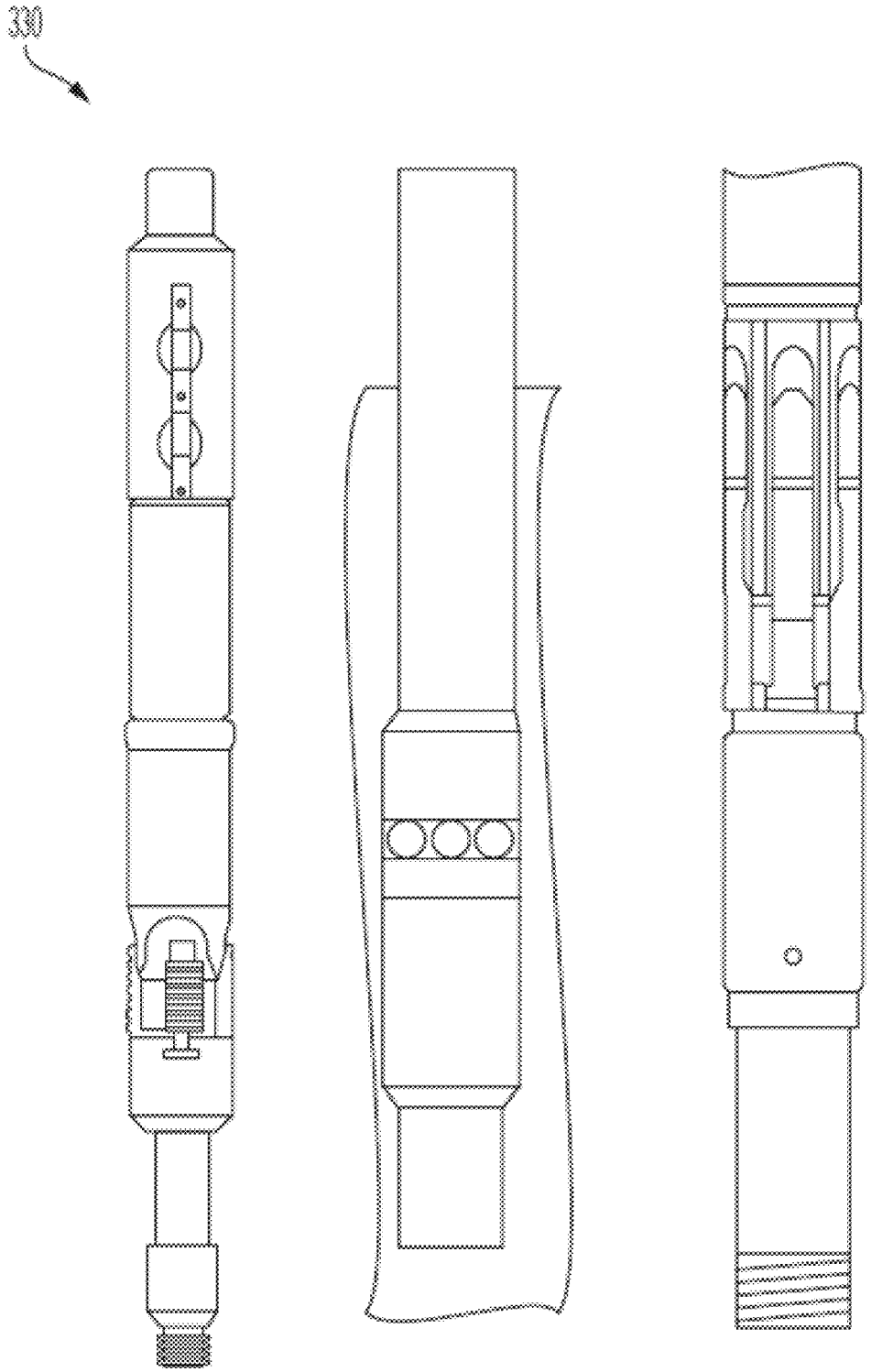

FIGS. 3A, 3B, and 3C illustrate example tools. Tools 310 shown in FIG. 3A include a drill pipe, a heavyweight drill pipe, drill dollars of different sizes, directional tools, and a bit. Tools 320 shown in FIG. 3B include wellhead tools of different sizes. Tools 330 shown in FIG. 3C include casing tools and completion tools. As seen in FIGS. 3A, 3B, and 3C, different tools may have different dimensions, and different parts of a tool may have different dimensions. Dimensional measurement information may characterize dimension of one or more of these tools. For example, dimensional measurement information may characterize external diameter, external shape, and/or other dimension of one or more of these tools. Dimensional measurement information may characterize external diameter, external shape, and/or other dimension of one or more of parts of these tools.

In some implementations, dimension of a tool characterized by the dimensional measurement information may include width of one or more parts of the tool as the tool moves into or out of the well. That is, as the tool is moving into or out of the well (e.g., tripping into or out of the well), the width of one or more parts of the tool may be measured and characterized by the dimensional measurement information.

In some implementations, dimension of a tool characterized by the dimensional measurement information may include shape of a part of the tool as the tool moves into or out of the well. That is, as the tool is moving into or out of the well (e.g., tripping into or out of the well), the shape of one or more parts of the tool may be measured and characterized by the dimensional measurement information. In some implementations, the shape of the tool/part(s) of the tool may be determined based on the dimensional measurement information. For example, the dimensional measurement information may characterize width of the tool as the toll is moved into or out of the well, and the width of the tool measured during the movement of the tool may be used to determine the shape of the tool. As another example, the dimensional measurement information may characterize width of different parts of the tool, and the width measurements may be compared to known width/shape of different tools to find the matching tool. The width/shape of non-measured parts of the tool may be determined from the known width/shape of the matching tool.

In some implementations, the dimensional measurement information may be generated by one or more dimensional sensors of the well. A dimensional sensor may refer to a device that monitors (e.g., measures, ascertains, detects, estimates) one or more physical properties. A dimensional sensor may include a device (e.g., transducer) that converts the monitored physical propert(ies) into output (e.g., electrical signals conveying dimensional measurement information). A dimensional sensor may utilize one or more technologies to generate dimensional measurement information of a tool. For example, a dimensional sensor may utilize light (e.g., light curtain, light screen), laser, LIDAR, electromagnetic field, radio signals, and/or other technologies to measure dimension of a tool. A dimensional sensor may include one or more communication devices that enable the dimensional sensor to remotely communicate the dimensional measurement information to other device(s) (e.g., to the system 10). For example, a dimensional sensor may utilize light emitting sensors and/or radar transmitters using radio waves.

In some implementations, a dimensional sensor may perform direct measurement dimension of a tool. For example, a dimensional sensor may directly measure length, width, height, area, volume, angle, and/or shape of the tool, and the measured dimension may be characterized by the dimensional measurement information. In some implementations, a dimensional sensor may perform indirect measurement dimension of a tool. For example, a dimensional sensor may measure the distance between the dimensional sensor and the tool, and the measured distance between the dimensional sensor and the tool may be used to determine dimension of the tool. As another example, a dimensional sensor may include a radio frequency identification (RFID) reader and one or more RFID tags may be positioned on/in the tool. The RFID tag(s) may transmit information relating to the dimension of the tool/part of the tool at the location of the RFID tag(s), information relating to identification of the tool/part of the tool at the location of the RFID tag(s), and/or other information that facilitates determination of the dimension of the corresponding tool/part of the tool. The RFID reader may detect the RFID tags within the range of the RFID reader, and the information transmitted by the RFID tags may be used to indirectly determine dimension of the tool/part of the tool. For instance, the RFID reader may read the information transmitted by an RFID tag as the RFID tag passes the RFID reader, and the transmitted information may be used to determine the dimension of the tool that passed by the RFID reader. The RFID technology may be used to determine location of tool/part of the tool. For example, an RFID reader may be positioned at/near the entrance of the wellbore, and the readings from a RFID tag attached to a tool/part of the tool may be used to determine when the tool/part of the tool enters or exits the wellbore.

In some implementations, the frequency with which a dimensional sensor performs measurement of the tool may depend on the rate at which the tool is moving into or out of the well. For example, the sampling rate of the dimensional sensor may be set so that the dimensional sensor is able to capture all changes in pipe sizes (including collars) at maximum expected tripping speeds.

Figure 4:
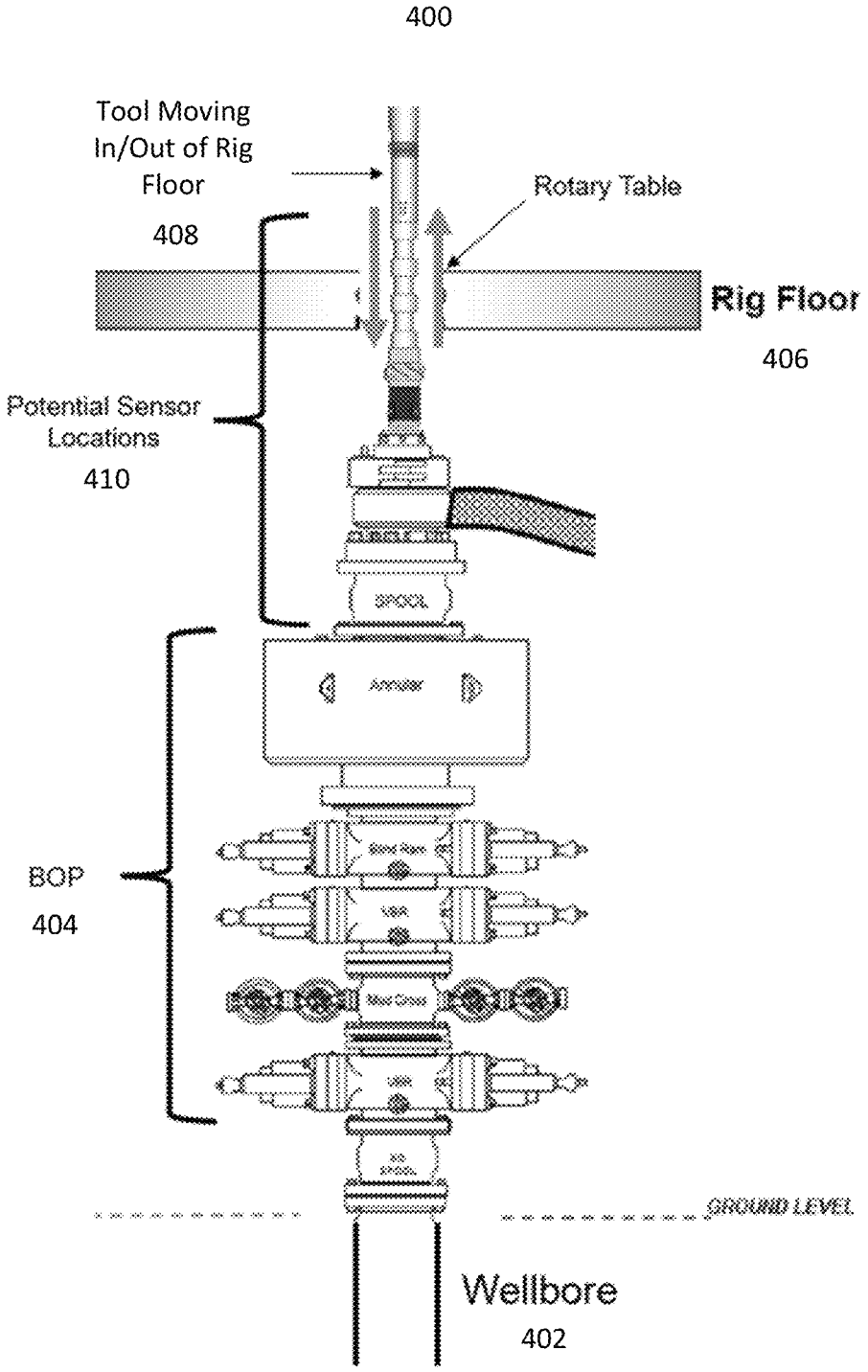
FIG. 4 illustrates example dimensional sensor locations.

The dimensional sensor(s) may be located at and/or below a rig floor of the well, and located above the well. For example, FIG. 4 illustrates example dimensional sensor locations. As shown in FIG. 4, a blowout preventer (BOP) 404 may be located above a wellbore 402. The BOP 404 may be located below a rig floor. Dimensional sensor(s) may be located along potential sensor locations 410, which extends from top of the BOP 404 to above the rig floor 406. Placing the dimensional sensor(s) at the potential sensor locations 410 may result in minimal disturbance to a typical rig designs and operations. Other locations of dimensional sensor(s) are contemplated.

The dimensional sensor(s) may measure dimension of a tool moving in or out of the rig floor 408. In some implementations, the dimensional sensor(s) may be positioned to measure dimension of the tool perpendicular to the movement of the tool. For example, with the tool moving vertically, the dimensional sensor(s) may be positioned to measure lateral dimension of the tool. For instance, the dimensional measurement information may be generated for a vertical position above the well (e.g., the wellbore 402). The dimension of the tool characterized by the dimensional measurement information may include the dimension of lateral slices of the tool. That is, the dimensional sensor(s) may be positioned to measure dimension of lateral slices of the tool (e.g., the tool) at a specific vertical position above the well. As the tool moves up and down, the dimensional sensor(s) may measure dimension of the tool that is located at/within the measurement plane of the dimensional sensor(s). Other angles of measurement for a tool by the dimensional sensor(s) are contemplated.

In some implementations, effect of one or more movement of a tool may be removed/reduced from the measured dimension of the tool. For example, referring to FIG. 4, the tool moving in or out of the rig floor 408 may include lateral movement of the pipe. That is, as the tool is moving vertically up or down, the tool may move laterally as well. In some implementations, a dimensional sensor may be able to handle such movement of the tool when measuring dimension of the tool. For example, a dimensional sensor may be able to factor in lateral movement of the pipe to measure dimension of the tool more accurately. As another example, dimensional measurement information provided by the dimensional sensor may be modified to factor in lateral movement of the tool to arrive at more accurate dimension measurement of the tool.

Figure 5:
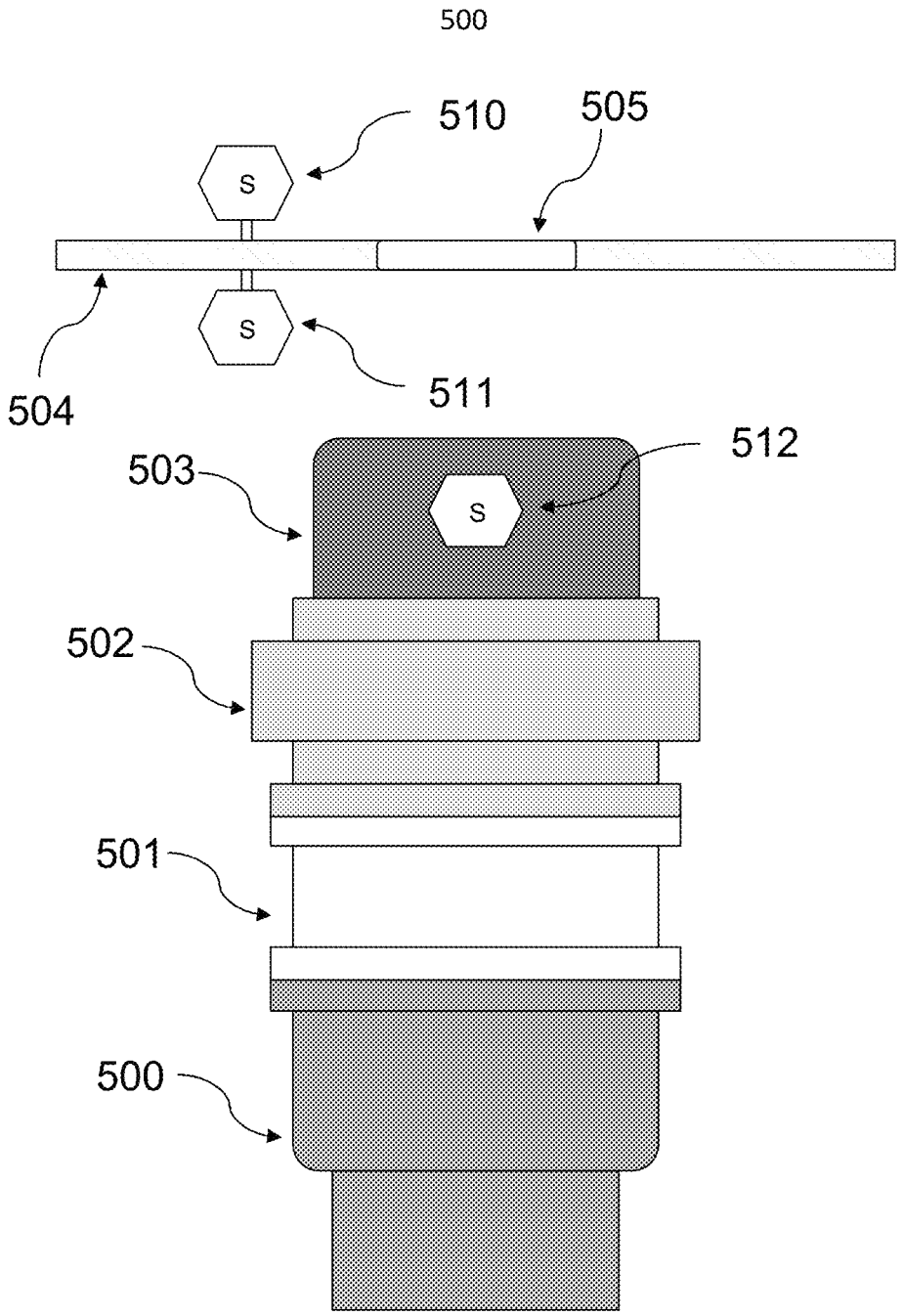
FIG. 5 illustrates an example onshore drilling rig diagram.

In some implementations, location of dimensional sensor(s) may depend on the environment of the well. For example, location of dimensional sensor(s) depend on whether the tool to be measured is for an onshore drilling rig or an offshore drilling rig. FIG. 5 illustrates an example onshore drilling rig diagram 500. The onshore drilling rig diagram 500 may include a wellhead 500 placed on top of a well. An adaptor/spool 501 may be attached to the top of the wellhead 500. A BOP stack/equipment 502 may be attached to the top of the adaptor/spool 501. A rotating head and/or a bell nipple 503 may be attached to the top of the BOP stack/equipment 502. A drilling rig floor 504 may be above the rotating head and/or the bell nipple 503. A rotary table 505 may be part of the drilling rig floor 504. The onshore drilling rig diagram 500 may include three example locations for dimensional sensor(s) (S). The example locations may include an above-rig-floor location 510, a below-rig-floor location 511, and an on-tool location 512. The on-tool location 512 may include the dimensional sensor(s) being connected and/or combined with the tool. For example, the on-tool location 512 may include the dimensional sensor(s) being connected and/or combined with the rotating head and/or the bell nipple 503. Other locations of dimensional sensor(s) for onshore drilling rig are contemplated.

Figure 6:
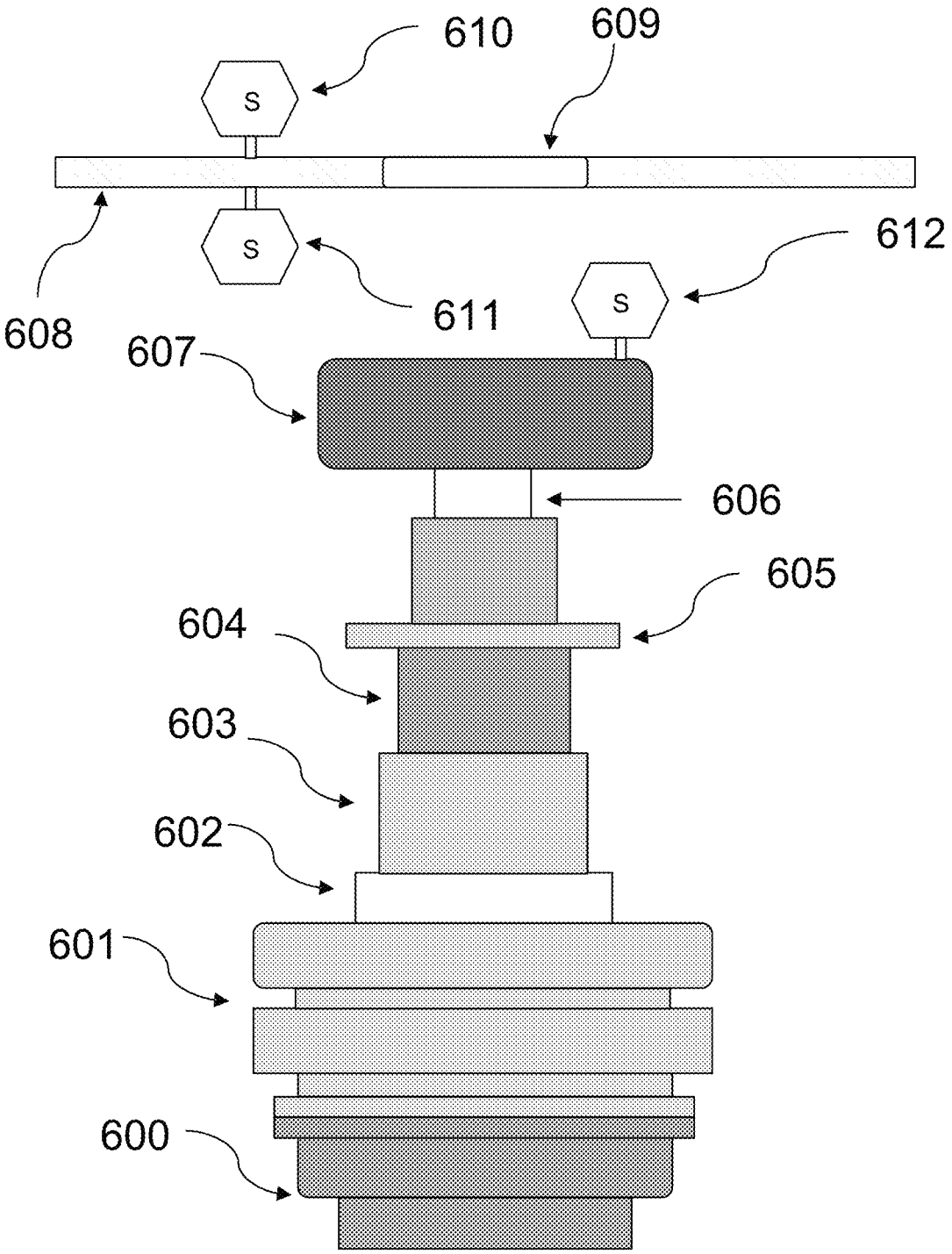
FIG. 6 illustrates an example offshore drilling rig subsea diagram.

FIG. 6 illustrates an example offshore drilling rig subsea diagram 600. The offshore drilling rig subsea diagram 600 may include a 600 placed on top of a well. A BOP and/or a lower marine riser package (LMRP) 601 may be attached to the top of the wellhead 600 or an adapter for the wellhead 600. A flex joint 602 may be attached to the top of the LMRP 601. The offshore drilling rig subsea diagram 600 may include buoyancy joints 603 used as part of a riser, an outer barrel for a telescopic pipe or joint 604, a tension ring 605, an inner barrel for the telescopic pipe or joint 606, and a diverter element 607. A drilling rig floor 608 may be above the diverter element 607. A rotary table 609 may be part of the drilling rig floor 608. The offshore drilling rig subsea diagram 600 may include three example locations for dimensional sensor(s) (S). The example locations may include an above-rig-floor location 610, a below-rig-floor location 611, and an on-tool location 612. The on-tool location 612 may include the dimensional sensor(s) being connected and/or combined with the tool. For example, the on-tool location 512 may include the dimensional sensor(s) being connected and/or combined with the diverter element 607. Other locations of dimensional sensor(s) for offshore drilling rig are contemplated. Other locations of dimensional sensor(s) for other environments of well are contemplated.

In some implementations, the dimensional sensor(s) may operate independently of other equipment of the well. For example, the dimensional sensor(s) may operate independently of the rig of the well. The dimensional sensor(s) operating independently of the rig may include the dimensional sensor(s) operating to generate the dimensional measurement information regardless of whether or not the rig is on the well. The dimensional sensor(s) operating independently of the rig may include the dimensional sensor(s) operating to generate the dimensional measurement information regardless of whether or not the rig is in operation. The dimensional measurement information generated by the dimensional sensor(s) may be used independently of the sensor information provided by the equipment of the well to perform well operation analysis.

In some implementations, the dimensional sensor(s) may operate with other equipment of the well. For example, the dimensional sensor(s) may operate with the rig of the well. The dimensional sensor(s) operating with the rig may include the dimensional sensor(s) operating to generate the dimensional measurement information when the rig is on the well. The dimensional sensor(s) operating with the rig may include the dimensional sensor(s) operating to generate the dimensional measurement information when the rig is in operation. The dimensional sensor(s) operating with the rig may include the dimensional sensor(s) operating to generate the dimensional measurement information for use with information generated by the sensor(s) of the rig. For example, tool dimension measurement may be performed by the dimensional sensor(s) to enhance the rig sensor data collection system. The dimensional measurement information generated by the dimensional sensor(s) may be used with the sensor information provided by the equipment of the well to perform well operation analysis. For instance, the tripping speed information provided by the rig may be used with the dimensional measurement information generated by the dimensional sensor(s) to perform well operation analysis.

Using information from sensors on the rig and/or other tools (e.g., standard rig instrumentation, manually recorded data) used in well operations may limit types of well operation analysis and/or reduce accuracy of well operation analysis that may be performed. The dimensional measurement information generated by the dimensional sensor(s) may enable new types of well operation analysis and/or increase accuracy of well operation analysis. For example, dimensional measurement information generated by the dimensional sensor(s) may enable analysis of flat time operations at the well (operations that are not deepening the well). The dimensional measurement information generated by the dimensional sensor(s) may enable real-time analysis of well operation remotely from the well.

The analysis component 104 may be configured to analyze operation of the well. Operation of a well may refer to performance of work on and/or usage of a well. Operation of a well may be divided into different stages and/or types of operation. For example, operation of a well may include a drilling operation, a completion operation, a production operation, or other operation of the well. Analyzing the operation of the well may include examining, monitoring, processing, studying, classifying, benchmarking, and/or other analysis of the operation of the well.

The operation of the well may be analyzed by the analysis component 104 based on the dimensional measurement information and/or other information. The analysis component 104 may utilize dimension of a tool for the well (measured by dimensional measurement sensor(s)) to analyze the operation of the well. Analysis of the operation of the well may include leveraging the information provided by the dimensional measurement of the tool for the well to measure and/or improve operation of the well. The dimensional measurement information may enable the analysis component 104 to monitor and/or track sizes of tool as the tool moves during operation of the well. For example, the dimensional measurement information may enable the analysis component 104 to monitor and/or track sizes of tool as the tool moves through the rotary table of a drilling rig. The dimensional measurement information may provide an automated digital footprint of tool(s) being used at the well and/or operations being performed at the well.

The analysis component 104 may determine the dimension of the tool (e.g., length, width, height, area, volume, angle, shape of the tool) based on dimensional measurement information and/or other information. For example, the analysis component 104 may determine the external diameter and/or shape of the tool as the tool moves between the general rig floor area and the top of the wellbore. The analysis component 104 may determine changes in the dimension of the tool based on dimensional measurement information and/or other information. For example, the analysis component 104 may determine changes in external diameter and/or shape of the tool as the tool moves by the dimensional sensor(s).

In some implementations, analysis of the operation of the well based on the dimensional measurement information may include identification of a type of the tool based on the dimension of the tool. Different tools may have different dimensions, such as different length, width, height, area, volume, angle, and/or shape. Identification of a type of the tool may include distinguishing between different categories of tools (e.g., drill pipe vs drill collar vs drilling bit) and/or distinguishing between different sub-categories of tools (e.g., 6.5" drill collar vs 8" drill collar). The analysis component 104 may match the measured dimension of the tool with known dimension of the tool to determine which tool is being used at the well. For example, the analysis component 104 may determine the size of the drill collar being used at the well based on the dimensional measurement information. As another example, the analysis component 104 may determine the shape of the tool based on the dimensional measurement information, and use the shape of the tool to distinguish between different types of tool (e.g., matching one or more irregular shape of the tool to a particular type of tool, such as a drill bit).

In some implementations, analysis of the operation of the well based on the dimensional measurement information may include determination that the tool is incompatible with the well based on the dimension of the tool. A tool being incompatible with the well may include the tool not being the correct tool to use at the well. A tool being incompatible with the well may include the tool not being the correct tool to use for operation being performed at the well. For example, a tool being incompatible with the well may include the tool being different from the tool that was planned to be used at the well. The analysis component 104 may compare the dimension of the tool with the dimension of the tool planned to be used at the well to determine whether or not the tool is or is not compatible with the well. For instance, the analysis component 104 may compare the shape of the tool with the shape of the tool that is planned to be used at the well. If the measured shape of the tool does not match the shape of the tool planned to be used at the well (e.g., not being the same shape, deviating from the shape by more than a threshold amount), the analysis component 104 may determine that the tool is incompatible with the well.

As another example, a tool being incompatible with the well may include the tool being too large for the well. The analysis component 104 may compare the dimension of the tool with the dimension of the well to determine whether or not the tool is or is not compatible with the well. For instance, the analysis component 104 may compare the external diameter of the tool with the minimum restriction of the well (smallest diameter in the wellbore through which a tool string must pass). If the external diameter of the tool violates the minimum restriction of the well (e.g., being later than a maximum value, being within a threshold of the maximum value), the analysis component 104 may determine that the tool is incompatible with the well.

In some implementations, the analysis component 104 may provide one or more alarms responsive to determination that the tool is incompatible with the well. For example, the analysis component 104 may generate one or more alarms and/or set one or more alarm flags. The analysis component 104 may pause or reverse the operation of the well responsive to determination that the tool is incompatible with the well.

In some implementations, analysis of the operation of the well based on the dimensional measurement information may include identification of a type of the operation of the well based on the dimension of the tool. Different operations may include use of tools having different dimensions. The analysis component 104 may match the measured dimension of the tool with the dimension of tool for different operations to determine which operation is being performed at the well. The analysis component 104 may use the measured dimension of the tool to determine the type(s) of tool being used at the well, and determine which operation is being performed at the well based on the identification of the type(s) of tool being used at the well.

In some implementations, analysis of the operation of the well based on the dimensional measurement information may include determination of a change in the operation of the well based on a change in the dimension of the tool. For example, based on changes in the measured size and/or shape of the tool, analysis component 104 may determine that a particular operation has started, a particular operation has ended, and/or that the well operation has switched from one operation to another operation. For instance, based on changes in the measured size and/or shape of the tool, the analysis component 104 may determine the states of the rig.

In some implementations, analysis of the operation of the well based on the dimensional measurement information may include determination of speed with which the tool moves into or out of the well based on a change in the dimension of the tool. Change in the dimension of the tool may be used to determine where the tool is located in the well/wellbore. For instance, the dimension of the tool being used at the well may be known, and change in the measured dimension of the tool may be used to determine which portion of the tool is within the well and which portion of the tool is not within the well. Different parts of the tool may have different dimensions and the change in dimension may indicate when different parts of the tool are passing by the dimensional sensor(s). Thus, change in the measured dimension of the tool may be used to how far the tool has moved into/out of the well. The locations of the tool in the well/wellbore determined at different times may be used to determine how far the tool has moved between the different times, which may then be used to calculate the speed (average speed) with which the tool is moving into or out of the well.

In some implementations, analysis of the operation of the well based on the dimensional measurement information may include monitoring, benchmarking, and/or automation of the operation of the well. For example, the dimensional measurement information may be used to remotely monitor, benchmark, and/or automate flat time operations (e.g., rig movement/skid times, rig maintenance, BOP nipple up & test, casing test, formation integrity test/leakoff test, rig up and down, bottom hole assembly handling, wellhead and jewelry installation, casing tools, liner hangers). The dimensional measurement information may be used to remotely monitor, benchmark, and/or automate downhole/drilling operations (e.g., downhole drilling, directional drilling & logging from downhole tools, trip speeds, wellbore instability indications, well control indications). For example, changes in dimension of the tool may signal when a change in operation has occurred at the well and enable tracking of when different operations are performed. Tracking these operational changes increases report automation, benchmarking capabilities, and remote monitoring of well operations. As another example, the dimensional measurement information may be used to determine how long certain tools are being used. For instance, the dimensional measurement information may be used to perform accurate time recording of downhole rental items, which may be used to reduce amount/chances of unnecessary rental time. Other monitoring, benchmarking, and/or automation of the operation of the well are contemplated.

Implementations of the disclosure may be made in hardware, firmware, software, or any suitable combination thereof. Aspects of the disclosure may be implemented as instructions stored on a machine-readable medium, which may be read and executed by one or more processors. A machine-readable medium may include any mechanism for storing or transmitting information in a form readable by a machine (e.g., a computing device). For example, a tangible computer-readable storage medium may include read-only memory, random access memory, magnetic disk storage media, optical storage media, flash memory devices, and others, and a machine-readable transmission media may include forms of propagated signals, such as carrier waves, infrared signals, digital signals, and others. Firmware, software, routines, or instructions may be described herein in terms of specific exemplary aspects and implementations of the disclosure, and performing certain actions.

In some implementations, some or all of the functionalities attributed herein to the system 10 may be provided by external resources not included in the system 10. External resources may include hosts/sources of information, computing, and/or processing and/or other providers of information, computing, and/or processing outside of the system 10.

Although the processor 11 and the electronic storage 13 are shown to be connected to the interface 12 in FIG. 1, any communication medium may be used to facilitate interaction between any components of the system 10. One or more components of the system 10 may communicate with each other through hard-wired communication, wireless communication, or both. For example, one or more components of the system 10 may communicate with each other through a network. For example, the processor 11 may wirelessly communicate with the electronic storage 13. By way of non-limiting example, wireless communication may include one or more of radio communication, Bluetooth communication, Wi-Fi communication, cellular communication, infrared communication, or other wireless communication. Other types of communications are contemplated by the present disclosure.

Although the processor 11 is shown in FIG. 1 as a single entity, this is for illustrative purposes only. In some implementations, the processor 11 may comprise a plurality of processing units. These processing units may be physically located within the same device, or the processor 11 may represent processing functionality of a plurality of devices operating in coordination. The processor 11 may be separate from and/or be part of one or more components of the system 10. The processor 11 may be configured to execute one or more components by software; hardware; firmware; some combination of software, hardware, and/or firmware; and/or other mechanisms for configuring processing capabilities on the processor 11.

It should be appreciated that although computer program components are illustrated in FIG. 1 as being co-located within a single processing unit, one or more of computer program components may be located remotely from the other computer program components. While computer program components are described as performing or being configured to perform operations, computer program components may comprise instructions which may program processor 11 and/or system 10 to perform the operation.

While computer program components are described herein as being implemented via processor 11 through machine-readable instructions 100, this is merely for ease of reference and is not meant to be limiting. In some implementations, one or more functions of computer program components described herein may be implemented via hardware (e.g., dedicated chip, field-programmable gate array) rather than software. One or more functions of computer program components described herein may be software-implemented, hardware-implemented, or software and hardware-implemented The description of the functionality provided by the different computer program components described herein is for illustrative purposes, and is not intended to be limiting, as any of computer program components may provide more or less functionality than is described. For example, one or more of computer program components may be eliminated, and some or all of its functionality may be provided by other computer program components. As another example, processor 11 may be configured to execute one or more additional computer program components that may perform some or all of the functionality attributed to one or more of computer program components described herein.

The electronic storage media of the electronic storage 13 may be provided integrally (i.e., substantially non-removable) with one or more components of the system 10 and/or as removable storage that is connectable to one or more components of the system 10 via, for example, a port (e.g., a USB port, a Firewire port, etc.) or a drive (e.g., a disk drive, etc.). The electronic storage 13 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. The electronic storage 13 may be a separate component within the system 10, or the electronic storage 13 may be provided integrally with one or more other components of the system 10 (e.g., the processor 11). Although the electronic storage 13 is shown in FIG. 1 as a single entity, this is for illustrative purposes only. In some implementations, the electronic storage 13 may comprise a plurality of storage units. These storage units may be physically located within the same device, or the electronic storage 13 may represent storage functionality of a plurality of devices operating in coordination.

Figure 2:
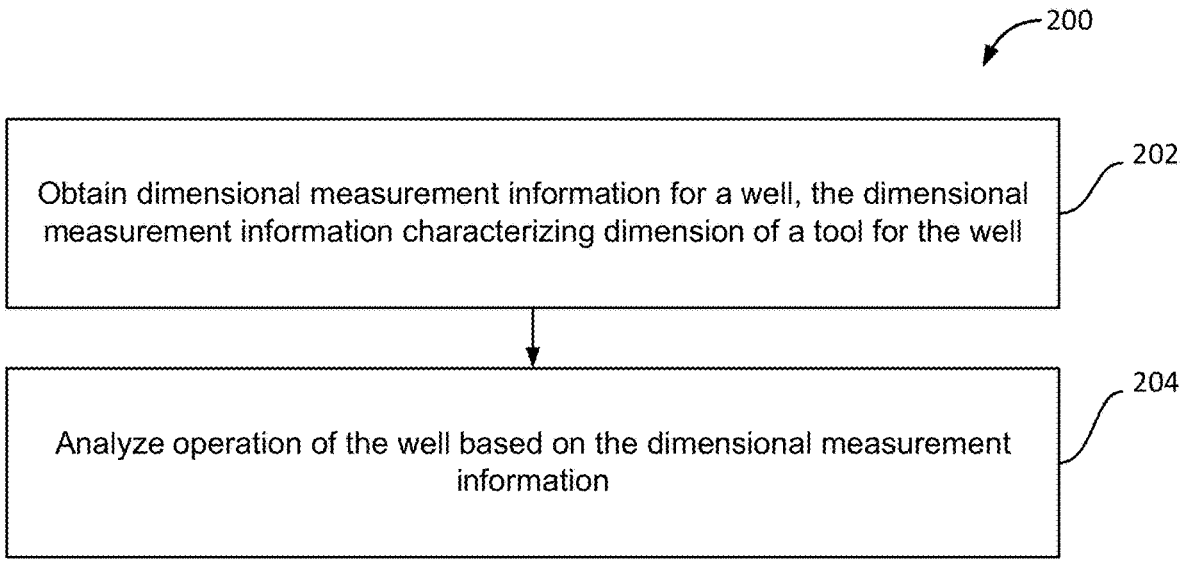
FIG. 2 illustrates an example method for analyzing well operations.

FIG. 2 illustrates method 200 for analyzing well operations. The operations of method 200 presented below are intended to be illustrative. In some implementations, method 200 may be accomplished with one or more additional operations not described, and/or without one or more of the operations discussed. In some implementations, two or more of the operations may occur substantially simultaneously.

In some implementations, method 200 may be implemented in one or more processing devices (e.g., a digital processor, an analog processor, a digital circuit designed to process information, a central processing unit, a graphics processing unit, a microcontroller, an analog circuit designed to process information, a state machine, and/or other mechanisms for electronically processing information). The one or more processing devices may include one or more devices executing some or all of the operations of method 200 in response to instructions stored electronically on one or more electronic storage media. The one or more processing devices may include one or more devices configured through hardware, firmware, and/or software to be specifically designed for execution of one or more of the operations of method 200.

Referring to FIG. 2 and method 200, at operation 202, dimensional measurement information for a well and/or other information may be obtained. The dimensional measurement information may characterize dimension of a tool for the well. In some implementation, operation 202 may be performed by a processor component the same as or similar to the dimension component 102 (Shown in FIG. 1 and described herein).

At operation 204, operation of the well may be analyzed based on the dimensional measurement information and/or other information. In some implementation, operation 204 may be performed by a processor component the same as or similar to the analysis component 104 (Shown in FIG. 1 and described herein).

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system for analyzing well operations, the system comprising:

a tool for a well, wherein the tool moves into or out of the well to perform an operation at the well;

multiple radio frequency identification tags positioned at multiple locations along the tool, the multiple radio frequency identification tags transmitting information on shape and/or width of the tool at corresponding locations along the tool, the multiple radio frequency identification tags including a first radio frequency identification tag and a second radio frequency identification tag, wherein the first radio frequency identification tag is positioned at a first location along the tool and transmits information on the shape and/or the width of the tool at the first location along the tool and the second radio frequency identification tag is positioned at a second location along the tool and transmits information on the shape and/or the width of the tool at the second location along the tool;

a radio frequency identification reader positioned at the well, the radio frequency receiving the information transmitted by the multiple radio frequency identification tags when the multiple radio frequency identification tags are within a range of the radio frequency identification reader, wherein the radio frequency identification reader receives the information transmitted by the multiple radio frequency identification tags as the tool moves into or out of the well; and one or more physical processors configured by machine-readable instructions to:

determine the shape and/or the width of the tool based on the information on the shape and/or the width of the tool at the multiple locations along the tool received from the multiple radio frequency identification tags by the radio frequency identification reader;

determine whether the tool is incompatible with the well based on the determined shape and/or the determined width of the tool, wherein determination that the tool is incompatible with the well includes determination that the tool is different from a planned tool that was planned to be used for the operation at the well or includes determination that the tool is too large for the well; and in response to determination that the tool is incompatible with the well, pause or reverse the operation at the well.

2. The system of claim 1, wherein the multiple radio frequency identification tags transmit information on the width of the tool at the corresponding locations along the tool, and the shape of the tool is determined based on the width of the tool at the multiple locations along the tool.

3. The system of claim 1, wherein the width of the tool includes an external diameter of the tool.

4. The system of claim 1, wherein the determined shape and/or the determined width of the tool is used to monitor and/or track size of the tool as the tool moves into or out of the well to perform the operation at the well.

5. The system of claim 1, wherein the determined shape and/or the determined width of the tool is used to measure dimension of lateral slices of the tool.

6. The system of claim 1, wherein a type of the operation being performed at the well is determined based on the determined shape and/or the determined width of the tool.

7. The system of claim 1, wherein determination of whether the tool is incompatible with the well based on the determined shape and/or the determined width of the tool includes determination of a type of the tool based on the determined shape and/or the determined width of the tool.

8. The system of claim 1, wherein the determination that the tool is too large for the well includes determination that the determined shape and/or the determined width of the tool exceeds a minimum restriction of the well.

9. A method for analyzing well operations, the method comprising:

receiving, via a radio frequency identification reader positioned at a well, information transmitted by multiple radio frequency identification tags when the multiple radio frequency identification tags are within a range of the radio frequency identification reader, the multiple radio frequency identification tags positioned at multiple locations along a tool for the well, the multiple radio frequency identification tags transmitting information on shape and/or width of the tool at corresponding locations along the tool, the multiple radio frequency identification tags including a first radio frequency identification tag and a second radio frequency identification tag, wherein the first radio frequency identification tag is positioned at a first location along the tool and transmits information on the shape and/or the width of the tool at the first location along the tool and the second radio frequency identification tag is positioned at a second location along the tool and transmits information on the shape and/or the width of the tool at the second location along the tool, wherein the tool moves into or out of the well to perform an operation at the well and the radio frequency identification reader receives the information transmitted by the multiple radio frequency identification tags as the tool moves into or out of the well;

determining the shape and/or the width of the tool based on the information on the shape and/or the width of the tool at the multiple locations along the tool received from the multiple radio frequency identification tags by the radio frequency identification reader;

determining whether the tool is incompatible with the well based on the determined shape and/or the determined width of the tool, wherein determining that the tool is incompatible with the well includes determining that the tool is different from a planned tool that was planned to be used for the operation at the well or determining that the tool is too large for the well; and in response to determining that the tool is incompatible with the well, pausing or reversing the operation at the well.

10. The method of claim 9, wherein the multiple radio frequency identification tags transmit information on the width of the tool at the corresponding locations along the tool, and the shape of the tool is determined based on the width of the tool at the multiple locations along the tool.

11. The method of claim 9, wherein the width of the tool includes an external diameter of the tool.

12. The method of claim 9, wherein the determined shape and/or the determined width of the tool is used to monitor and/or track size of the tool as the tool moves into or out of the well to perform the operation at the well.

13. The method of claim 9, wherein the determined shape and/or the determined width of the tool is used to measure dimension of lateral slices of the tool.

14. The method of claim 9, wherein a type of the operation being performed at the well is determined based on the determined shape and/or the determined width of the tool.

15. The method of claim 9, wherein determining whether the tool is incompatible with the well based on the determined shape and/or the determined width of the tool includes determining a type of the tool based on the determined shape and/or the determined width of the tool.

16. The method of claim 9, wherein determining that the tool is too large for the well includes determining that the determined shape and/or the determined width of the tool exceeds a minimum restriction of the well.

* * * * *